US010539328B2

(12) United States Patent
Kamoi et al.

(10) Patent No.: US 10,539,328 B2
(45) Date of Patent: Jan. 21, 2020

(54) STRUCTURE FOR SUPPORTING NOZZLE GUIDE OF GAS TURBINE ENGINE

(71) Applicant: HONDA MOTOR CO., LTD., Tokyo (JP)

(72) Inventors: Yasuharu Kamoi, Wako (JP); Takeshi Kiyama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 392 days.

(21) Appl. No.: 15/220,534

(22) Filed: Jul. 27, 2016

(65) Prior Publication Data

US 2018/0031245 A1 Feb. 1, 2018

(51) Int. Cl.
*F23R 3/60* (2006.01)
*F23R 3/28* (2006.01)

(52) U.S. Cl.
CPC ..... *F23R 3/60* (2013.01); *F23R 3/283* (2013.01); *F23R 2900/00017* (2013.01); *F23R 2900/00018* (2013.01)

(58) Field of Classification Search
CPC .. F23R 3/283; F23R 3/60; F23R 2900/00017; F23R 2900/00018
See application file for complete search history.

(56) References Cited

U.S. PATENT DOCUMENTS 4,322,945 A * 4/1982 Peterson ..... F23R 3/283 60/740
2012/0186260 A1* 7/2012 DiCintio ..... F01D 9/023 60/752

FOREIGN PATENT DOCUMENTS

JP 04-244513 9/1992

* cited by examiner

*Primary Examiner* — Scott J Walthour
(74) *Attorney, Agent, or Firm* — Rankin, Hill & Clark LLP

(57) ABSTRACT

A nozzle guide support device, that supports a nozzle guide of a fuel nozzle on an open flange part encircling a fuel supply hole of a combustor of a gas turbine engine, is formed by fixing a cap that supports the nozzle guide in a floating state to the open flange part by means of a rivet. Rotation of the nozzle guide relative to the open flange part is restricted by engagement between a recess portion of the nozzle guide and a spacer fitted to the rivet. Accordingly, not only is it possible to cut production time and production cost compared with a case in which the nozzle guide support device is fixed by welding or brazing, but it is also possible to suppress unlimited rotation of the fuel nozzle guide while enabling the fuel nozzle guide to float in a radial direction and a axial direction.

4 Claims, 6 Drawing Sheets

STRUCTURE FOR SUPPORTING NOZZLE GUIDE OF GAS TURBINE ENGINE

BACKGROUND OF THE INVENTION

Field of the Invention

The present invention relates to a structure for supporting a nozzle guide of a gas turbine engine in which a nozzle guide of a fuel nozzle is supported in a radially and axially floating state on an open flange part encircling a fuel supply hole formed in a combustor of the gas turbine engine by nozzle guide support means.

Description of Related Art

Such a structure for supporting a nozzle guide of a gas turbine engine is known from Japanese Patent Application Laid-open No. 4-244513. This invention enables a constant amount of air to flow in a gap between a support plate (open flange part) and a fuel injection nozzle (fuel nozzle) fitted into a ferrule (nozzle guide), even when the fuel injection nozzle moves relative to the support plate, by welding a retaining plate (cap) to extremities of elliptical flanges projectingly provided on the support plate encircling a dome inlet (fuel supply hole) of a combustor and by supporting the ferrule in a floating state in a space formed between the support plate and the retaining plate.

However, the above arrangement not only has the problem that production time and production cost are high because the retaining plate is welded to an entire periphery of the flanges of the support plate encircling the dome inlet of the combustor, but there is also a possibility that, since rotation of the ferrule relative to the support plate is prevented by fitting the elliptical ferrule into an interior of the elliptical flanges of the support plate 50, the rotation-preventing structure will increase in size to thus become a main cause for an increase in weight.

SUMMARY OF THE INVENTION

The present invention has been accomplished in light of the above circumstances, and it is an object thereof to support a nozzle guide on an open flange part of a combustor in a simple manner and to reliably prevent rotation of the nozzle guide relative to the open flange part.

In order to achieve the object, according to a first aspect of the present invention, there is provided a structure for supporting a nozzle guide of a gas turbine engine in which a nozzle guide of a fuel nozzle is supported in a radially and axially floating state on an open flange part encircling a fuel supply hole formed in a combustor of the gas turbine engine by nozzle guide support means, wherein the nozzle guide support means is fixed to the open flange part by swage-joining, and rotation of the nozzle guide relative to the open flange part is restricted by engagement between a recess portion provided in the nozzle guide and a projecting part provided on a swaged member of the nozzle guide support means.

In accordance with the first aspect, the nozzle guide of the fuel nozzle is supported in a radially and axially floating state on the open flange part encircling the fuel supply hole formed in the combustor of the gas turbine engine by the nozzle guide support means. Since the nozzle guide support means is fixed to the open flange part by swage-joining, and rotation of the nozzle guide relative to the open flange part is restricted by engagement between the recess portion provided in the nozzle guide and the projecting part provided on the swaged member of the nozzle guide support means, not only is it possible to cut production time and production cost compared with a case in which the nozzle guide support means is fixed by welding or brazing, but it is also possible to suppress unlimited rotation of the fuel nozzle guide while enabling the fuel nozzle guide to float in the radial direction and the axial direction.

According to a second aspect of the present invention, in addition to the first aspect, a plurality of the nozzle guide support means are disposed at predetermined intervals in a circumferential direction of the open flange part.

In accordance with the second aspect, since the plurality of nozzle guide support means are disposed at predetermined intervals in the circumferential direction of the open flange part, it is possible to cut total weight of the nozzle guide support means compared with a case in which one nozzle guide support means is provided so as to follow an entire periphery of the open flange part.

According to a third aspect of the present invention, in addition to the first or second aspect, the nozzle guide support means comprises a cap that supports the nozzle guide in a radially and axially floating state, a rivet that fixes the cap to the open flange part, and a spacer that is fitted around the outer periphery of the rivet to thus form the projecting part.

In accordance with the third aspect, since the nozzle guide support means includes the cap supporting the nozzle guide in a radially and axially floating state, the rivet fixing the cap to the open flange part, and the spacer fitted onto the outer periphery of the rivet to thus form a projecting part, not only is it possible to easily and reliably fix the cap to the open flange part, but it is also possible to restrict the gap between the open flange part and the cap with good precision by utilizing the spacer forming the projecting part.

According to a fourth aspect of the present invention, in addition to the third aspect, the spacer is formed integrally with the open flange part.

In accordance with the fourth aspect, since the spacer is formed integrally with the open flange part, not only is it possible to cut the number of components, but ease of operation when securing the cap and the spacer by means of the rivet also improves.

According to a fifth aspect of the present invention, in addition to the third or fourth aspect, the cap comprises a stopper portion that can abut against an outer peripheral face of the open flange part.

In accordance with the fifth aspect, since the cap includes the stopper portion, which can abut against the outer peripheral face of the open flange part, it is possible to prevent the cap from rotating around the rivet.

According to a sixth aspect of the present invention, in addition to the first or second aspect, the nozzle guide support means comprises a clip that is joined by swaging to the open flange part, the clip integrally comprising a retaining portion that supports the nozzle guide in a radially and axially floating state, and the projecting part that engages with the recess portion of the nozzle guide.

In accordance with the sixth aspect, since the nozzle guide support means is formed from the clip joined to the open flange part by swaging, and the clip integrally includes the retaining portion supporting the nozzle guide in a radially and axially floating state and the projecting part engaging with the recess portion of the nozzle guide, it is possible to form the nozzle guide support means from a single component, thus cutting the number of components and the number of assembly steps.

Note that a spacer 19 of embodiments corresponds to the projecting part of the present invention, and a rivet 21 and a clip 23 of the embodiments correspond to the swaged member of the present invention.

The above and other objects, characteristics and advantages of the present invention will be clear from detailed descriptions of the preferred embodiments which will be provided below while referring to the attached drawings.

BRIEF DESCRIPTION OF THE DRAWINGS

FIG. 1 is a longitudinal sectional view of a combustor of a gas turbine engine;

FIG. 2 is an enlarged view of part 2 in FIG. 1;

FIG. 3 is a view in the direction of arrow 3 in FIG. 1; and

FIG. 4 is a view in the direction of arrow 4 in FIG. 1.

FIG. 5 is a diagram corresponding to FIG. 2 of the first embodiment; and FIG. 6 is a diagram corresponding to FIG. 3 of the first embodiment.

DESCRIPTION OF THE PREFERRED EMBODIMENTS

A first embodiment of the present invention is explained below by reference to FIG. 1 to FIG. 4.

Figure 1:
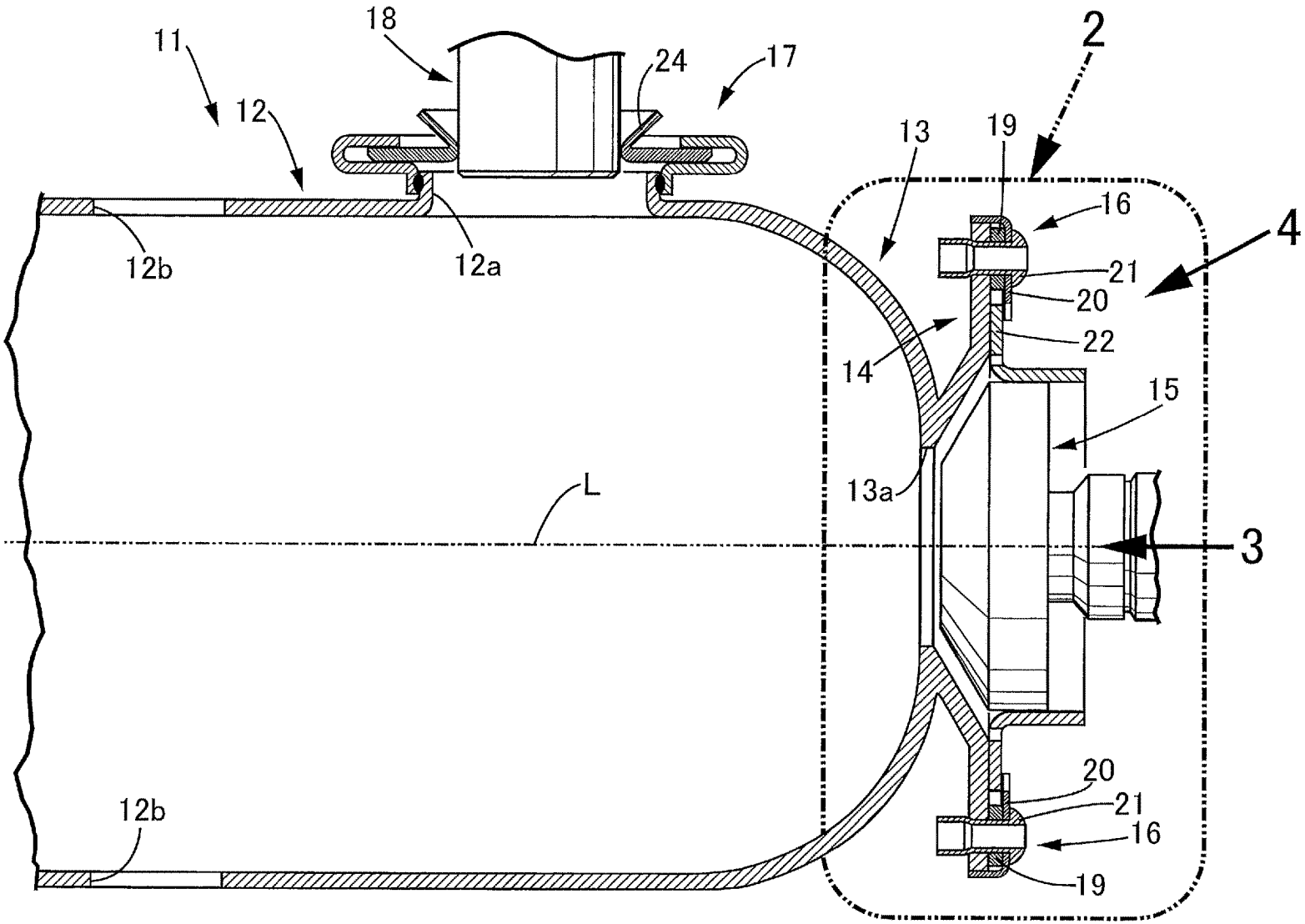
FIG. 1 to FIG. 4 show a first embodiment of the present invention.

As shown in FIG. 1, a combustor 11 disposed so as to encircle an engine axis of a gas turbine engine includes an annular combustor main body part 12 and a dome part 13 blocking one end part of the combustor main body part 12. A plurality of open flange parts 14 are disposed, at equal intervals on a circumference having the engine axis as the center, on the semicircular cross section dome part 13, and the extremities of fuel nozzles 15 for injecting fuel into the interior of the combustor 11 via fuel supply holes 13*a* formed in the center of the open flange parts 14 are covered with a nozzle guide 22 supported in a floating state by nozzle guide support means 16. Furthermore, a plurality of spark plug fitting holes 12*a* are formed in an outer peripheral wall of the combustor main body part 12 at equal intervals in the circumferential direction, and the extremities of spark plugs 18 are inserted into spark plug support collars 24 supported in a floating state by spark plug support means 17 provided on the spark plug fitting holes 12*a*. The fuel nozzle 15 includes an air supply hole encircling the periphery of the fuel injection hole, and air passing through the air supply hole is supplied into the interior of the combustor 11 via the periphery of the fuel injection hole in a swirl flow.

The combustor 11 is cantilever-supported on a casing of the gas turbine engine via an inner peripheral part thereof, and since base end parts of the fuel nozzles 15 and the spark plugs 18 are cantilever-supported on the casing, the fuel nozzles 15 and the spark plugs 18 move relative to the combustor 11 due to a difference in the amount of thermal expansion of each part accompanying change in temperature of the gas turbine engine. In order to allow this relative movement, the extremities of the fuel nozzles 15 are covered with the nozzle guide 22 supported on the nozzle guide support means 16 in a floating state, and the extremities of the spark plugs 18 are inserted into spark plug support collars 24 supported by the spark plug support means 17 in a floating state. Formed in the outer peripheral wall and an inner peripheral wall of the combustor main body part 12 are a plurality of air inlet holes 12*b* for introducing air for combustion into the interior of the combustor 11.

Figure 2:
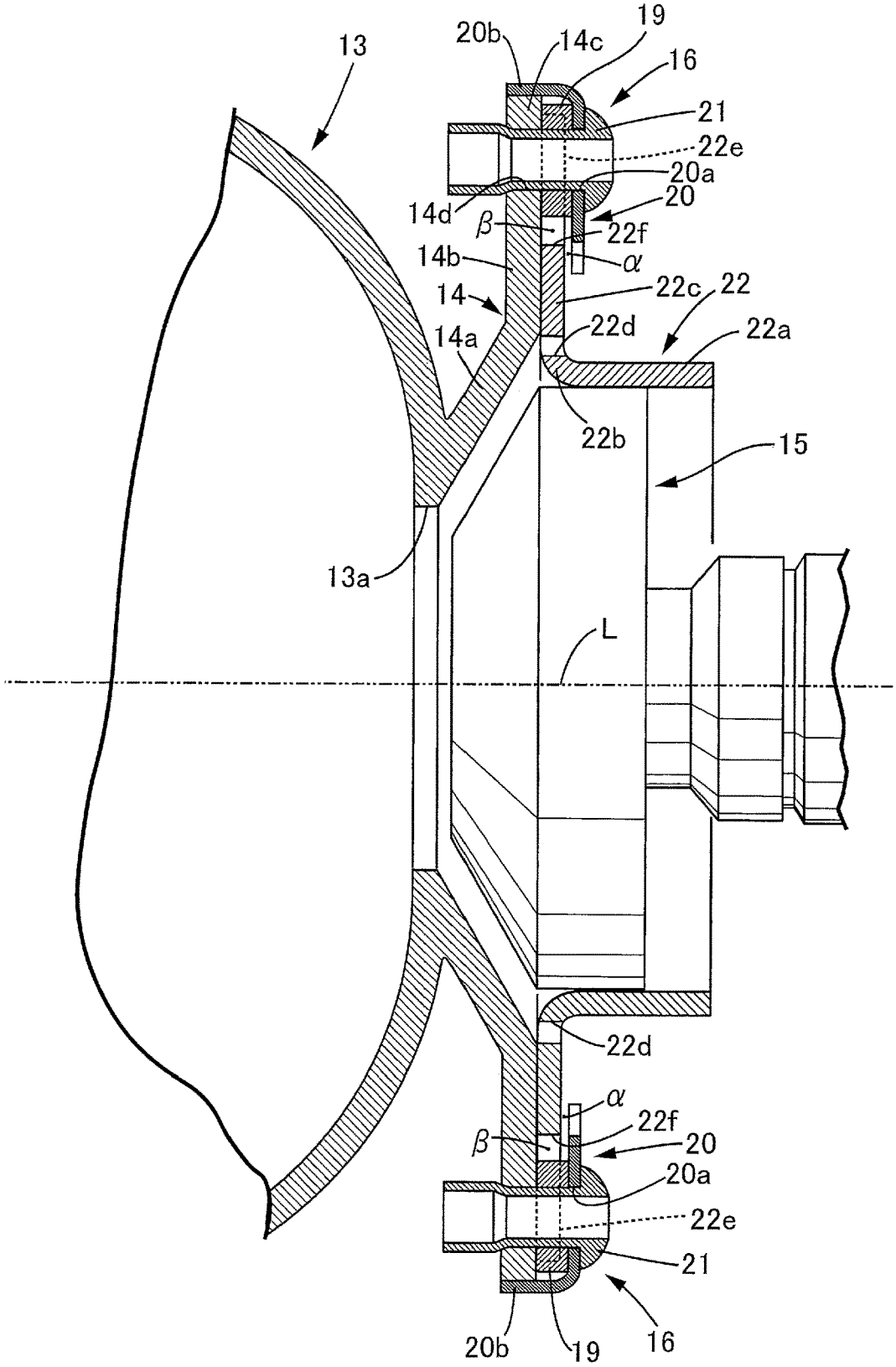
Figure 3:
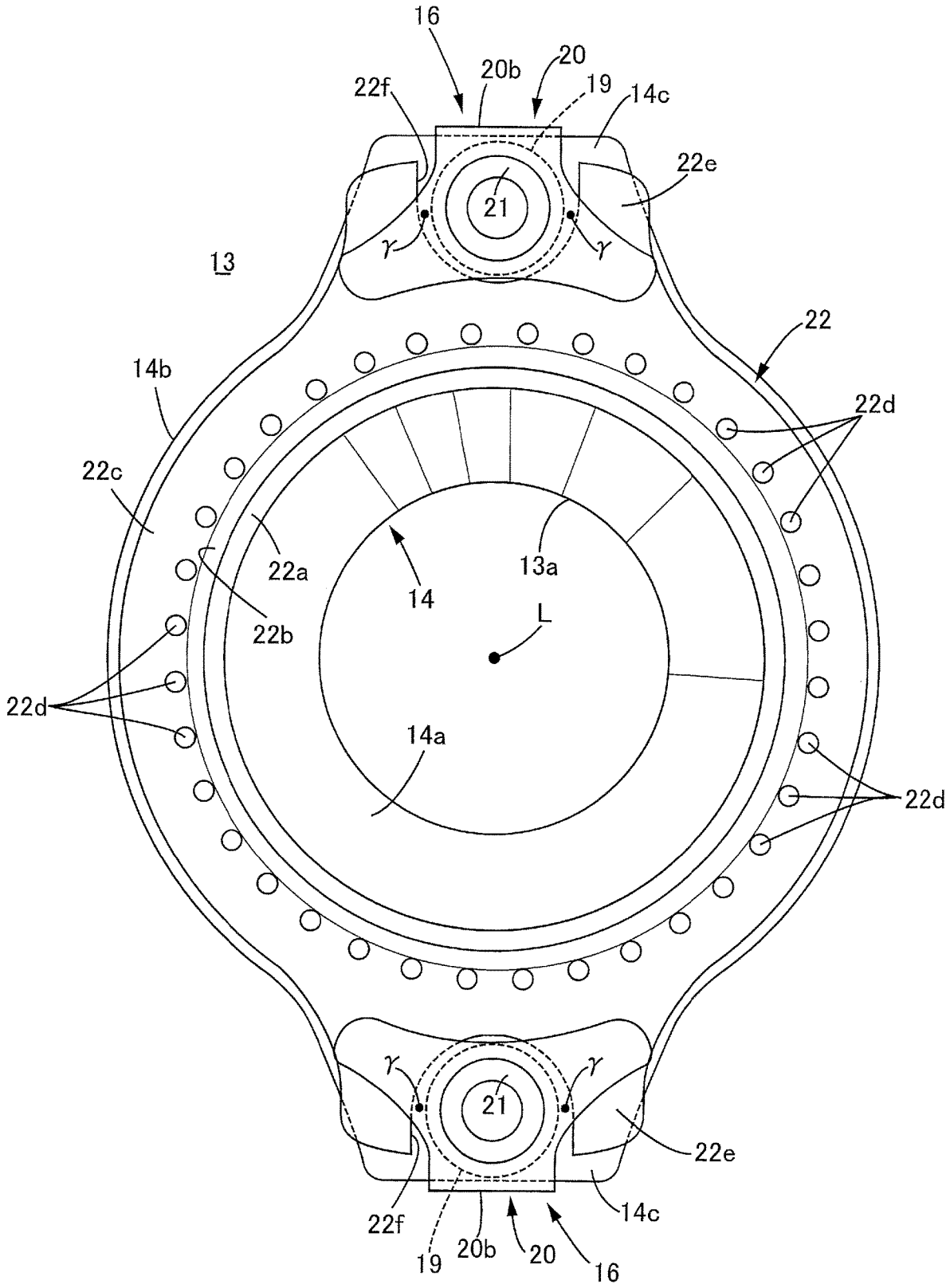
Figure 4:
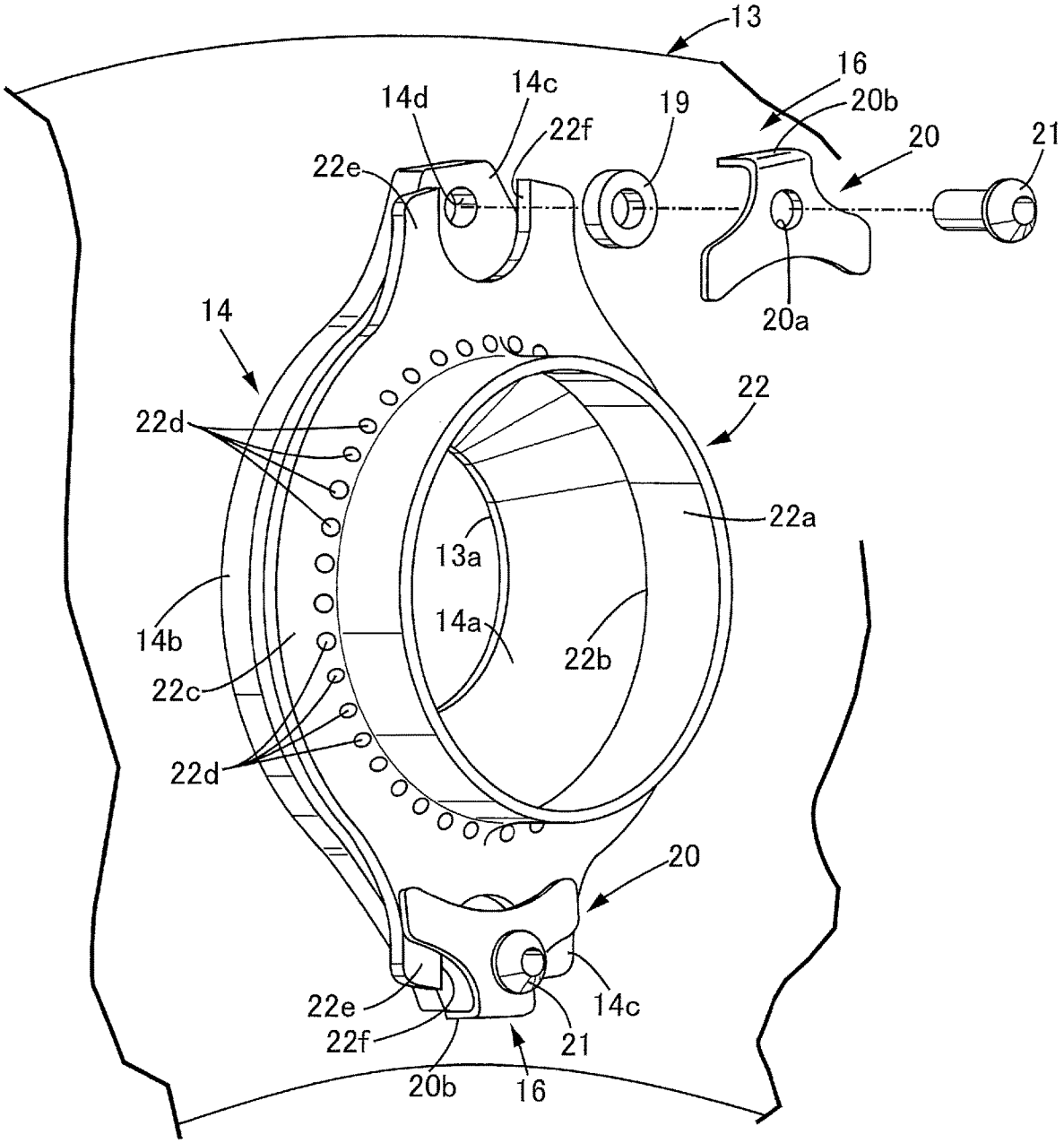

The structure of the nozzle guide support means 16 is now explained by reference to FIG. 2 to FIG. 4.

The open flange part 14 of the combustor 11 includes a conical portion 14*a* that enlarges in a conical manner from the outer periphery of the fuel supply hole 13*a* along an axis L of the fuel nozzle 15, a flat portion 14*b* that extends from the extremity of the conical portion 14*a* radially outward with respect to the axis L, and two projecting portions 14*c* that project radially outward from two positions, having the axis L interposed therebetween, at the radially outer ends of the flat portion 14*b*, rivet holes 14*d* extending through extremities of the projecting portions 14*c*. A cylindrical spacer 19 and a cap 20 formed by bending a plate material are superimposed on the projecting portion 14*c* and are fixed by swaging the extremity of a rivet 21 extending in the axis L direction through a rivet hole 20*a* of the cap 20, the spacer 19, and the rivet hole 14*d* of the projecting portion 14*c*. Formed at the radially outer end of the cap 20 is a stopper portion 20*b* that is bent at right angles, the stopper portion 20*b* engaging with an outer peripheral face of the radially outer end of the projecting portion 14*c* of the open flange part 14.

The nozzle guide 22, which is formed into an annular shape, includes a cylindrical portion 22*a* into which the fuel nozzle 15 is fitted and a bottom flange portion 22*c* that is bent from a corner portion 22*b* at one end of the cylindrical portion 22*a* at right angles and extends radially outward, and a plurality of cooling holes 22*d* extending in the axis L direction extend through a radially inner end part of the bottom flange portion 22*c* that is adjacent to the corner portion 22*b*. Two projecting portions 22*e* superimposed on the two projecting portions 14*c* of the open flange part 14 project from radially outer ends of the bottom flange portion 22*c* of the nozzle guide 22, and U-shaped recess portions 22*f* opening radially outward are formed in the projecting portions 22*e*.

The projecting portion 22*e* of the nozzle guide 22 is sandwiched between the cap 20 and the projecting portion 14*c* of the open flange part 14, and the recess portion 22*f* of the nozzle guide 22 is loosely fitted onto the outer periphery of the spacer 19. In this state, the bottom flange portion 22*c* and the projecting portion 22*e* of the nozzle guide 22 have a gap $\alpha$ (see FIG. 2) in the axis L direction between the cap 20 and the flat portion 14*b* and the projecting portion 14*c* of the open flange part 14. The recess portion 22*f* of the nozzle guide 22 has a gap $\beta$ (see FIG. 2) in the radial direction and a gap $\gamma$ (see FIG. 3) in the circumferential direction between itself and the outer periphery of the spacer 19. Therefore, the nozzle guide 22 can move in the axis L direction, the radial direction, and the circumferential direction relative to the open flange part 14.

The operation of the embodiment of the present invention having the above arrangement is now explained.

During running of the gas turbine engine, air that has been compressed by a compressor is supplied to a space around the combustor 11 and is supplied therefrom to the interior of the combustor 11 after passing through the air inlet holes 12*b* of the combustor main body part 12 and the interior of the fuel nozzles 15, and the air is mixed with fuel injected from the fuel nozzle 15 in the interior of the combustor 11, thus carrying out combustion. Combustion gas generated by combustion is discharged from the combustor 11 and drives a turbine, and is then discharged via an exhaust nozzle and generates thrust. The spark plugs 18 ignite the mixed gas when the gas turbine engine is started, and combustion of the mixed gas continues automatically after starting the gas turbine engine. Furthermore, air in the space around the combustor 11 passes through the cooling holes 22*d* of the nozzle guide 22 and is supplied to the interior of the combustor 11, and in this process it cools the open flange part 14 and the fuel nozzle 15.

Since the annular combustor 11 is cantilever-supported on the casing of the gas turbine engine via its inner peripheral part, and the base end parts of the fuel nozzles 15 and the spark plugs 18 are also cantilever-supported on the casing of the gas turbine engine, the fuel nozzles 15 and the spark plugs 18 move relative to the combustor 11 due to differences in the amount of thermal expansion accompanying change in temperature of the gas turbine engine.

However, since the nozzle guide 22 of the fuel nozzle 15 is supported on the open flange part 14 of the combustor 11 via the nozzle guide support means 16, this nozzle guide support means 16 enables the nozzle guide 22 to move relative to the open flange part 14 in the axis L direction in a range of the gap $\alpha$, in the radial direction in a range of the gap $\beta$, and in the circumferential direction in a range of the gap $\gamma$, these relative movements being allowed by the action of the gaps $\alpha$, $\beta$, and $\gamma$.

Since assembly of the nozzle guide support means 16 is carried out by swaging the extremity of the rivet 21 extending through the rivet hole 20*a* of the cap 20, the spacer 19, and the rivet hole 14*d* of the projecting portion 14*c* of the open flange part 14 in the axis L direction, it becomes possible to cut the production time and the production cost compared with a case in which the nozzle guide support means 16 is assembled by welding or brazing.

Furthermore, since the nozzle guide support means 16, which are divided into two parts, are disposed on the open flange part 14 at intervals of 180° in the circumferential direction, it is possible to cut the total weight of the nozzle guide support means 16 compared with a case in which one nozzle guide support means 16 is provided so as to follow the entire periphery of the open flange part 14.

Moreover, since the nozzle guide support means 16 includes the cap 20 supporting the nozzle guide 22 in a floating state, the rivet 21 fixing the cap 20 to the open flange part 14, and the spacer 19 fitted onto the outer periphery of the rivet 21 to thus form a projecting part for preventing rotation, it is possible to prevent rotation of the nozzle guide 22, and not only is it possible to easily and reliably fix the cap 20 to the open flange part 14, but it is also possible to restrict the gap in the axis L direction between the open flange part 14 and the cap 20 with good precision by utilizing the spacer 19 forming the projecting part. Furthermore, it becomes easy to replace the nozzle guide 22 with a new product when it has deteriorated, thus improving the ease of maintenance.

Moreover, since the cap 20 includes the stopper portion 20*b*, which can abut against the outer peripheral face of the projecting portion 14*c* of the open flange part 14, it is possible by means of the stopper portion 20*b* to prevent the cap 20 from rotating around the rivet 21.

Figure 5:
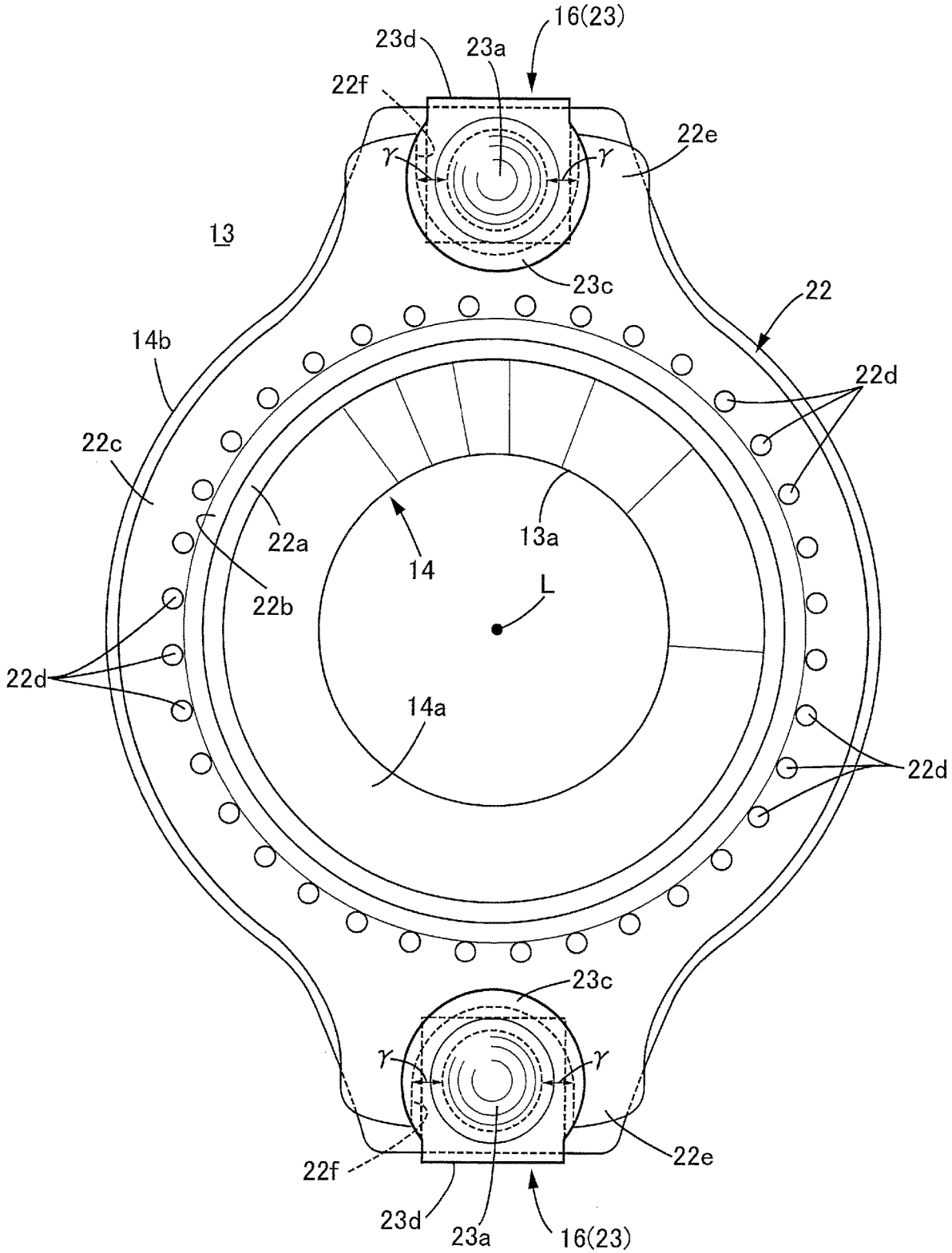
FIG. 5 and FIG. 6 show a second embodiment of the present invention.
Figure 6:
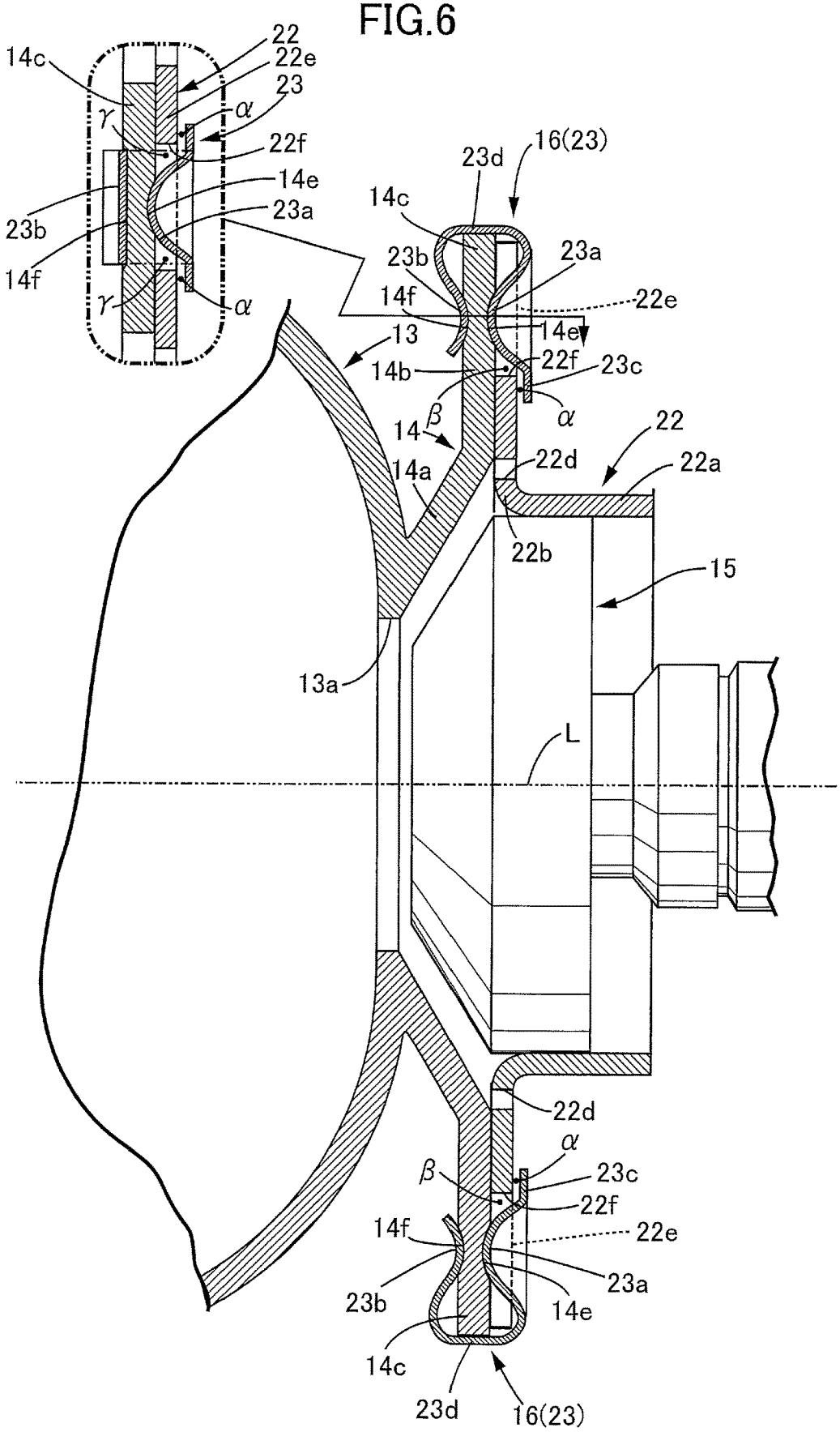

A second embodiment of the present invention is now explained by reference to FIG. 5 and FIG. 6.

The second embodiment is different from the first embodiment in terms of the structure of nozzle guide support means 16, the nozzle guide support means 16 being formed from a clip 23, which is a single member. The clip 23, which is formed by bending a substantially rectangular plate material through 180° via its middle part, is fixed to a projecting portion 14*c* of an open flange part 14 by swaging, and includes two projecting portions 23*a* and 23*b* fitted into indentations 14*e* and 14*f* formed in opposite faces of the projecting portion 14*c* of the open flange part 14. One projecting portion 23*a* is formed into a hemispherical shape, is fixed to the indentation 14*e*, which is hemispherical, of the projecting portion 14*c* of the open flange part 14, and is loosely fitted into a recess portion 22*f* of a projecting portion 22*e* of a nozzle guide 22, and a retaining portion 23*c* extending radially inward from the projecting portion 23*a* opposes a bottom flange portion 22*c* and the projecting portion 22*e* of the nozzle guide 22 across a gap. The other projecting portion 23*b* is formed into a semi-cylindrical shape and is fixed to the indentation 14*f*, which is semi-cylindrical, of the projecting portion 14*c* of the open flange part 14. Furthermore, a bent portion 23*d* at the radially outer end of the clip 23 abuts against a radially outer end face of the projecting portion 14*c* of the open flange part 14, thus suppressing rotation of the clip 23 around the projecting portion 23*a*.

In accordance with the present embodiment, the same effects as those of the first embodiment can be achieved and, furthermore, since the nozzle guide support means 16 is formed from the clip 23, which is a single member, joined by swaging to the open flange part 14, it is possible to cut the number of components and the number of assembly steps compared with the nozzle guide support means 16 of the first embodiment.

Embodiments of the present invention are explained above, but the present invention may be modified in a variety of ways as long as the modifications do not depart from the gist thereof.

For example, in the embodiment, the spacer 19 is formed from an independent component, but this spacer 19 may be formed integrally with the open flange part 14, and by so doing not only can the number of components be cut, but the ease of operation when securing the cap 20 and the spacer 19 by means of the rivet 21 also improves.

What is claimed is:

1. A structure comprising:

a nozzle guide of a fuel nozzle of a gas turbine engine, a combustor of the gas turbine engine; and a nozzle guide support supporting the nozzle guide on the combustor, wherein the combustor includes an open flange part encircling a fuel supply hole formed in the combustor, the open flange part includes a projecting portion that projects radially outward, and a rivet hole is defined through the projecting portion, the nozzle guide support comprising:

a cap formed by bending a plate material, wherein a cap rivet hole is defined through the cap;

a rivet; and a spacer, wherein the cap and the spacer are superimposed on the projecting portion with both the cap rivet hole and a hole defined through the spacer being aligned with the rivet hole of the projecting portion, and the cap and the spacer are fixed to the open flange part by the rivet, the rivet extending through each of the cap rivet hole, the hole defined through the spacer, and the rivet hole of the projecting portion, the rivet being swaged to swage-join the cap and the spacer to the open flange part, wherein the nozzle guide includes a recess portion that is fitted onto an outer periphery of the spacer so that the nozzle guide support supports the nozzle guide in a radially- and axially-floating state on the open flange part, with rotation of the nozzle guide relative to the open flange part being restricted by engagement between the recess portion of the nozzle guide and a projecting part formed by the spacer, the spacer being fitted around an outer periphery of the rivet.

2. The structure according to claim 1, wherein the cap comprises a stopper portion bent at a right angle from a radially outer end of a main body of the cap, the stopper portion abutting an outer peripheral face of a radially outer end of the projecting portion of the open flange part.

3. A structure comprising:

a nozzle guide of a fuel nozzle of a gas turbine engine;

a combustor of the gas turbine engine; and a nozzle guide support supporting the nozzle guide on the combustor, wherein the combustor includes an open flange part encircling a fuel supply hole formed in the combustor, the open flange part having a projecting portion that projects radially outward, and a hemispherical indentation is formed in the projecting portion, the nozzle guide support comprises a clip formed by bending a substantially rectangular plate material 180 degrees at a middle part of the substantially rectangular plate material, wherein the clip is joined by swaging to the open flange part, wherein the clip integrally comprises:

a clip projecting portion having a hemispherical shape and fitted into the hemispherical indentation formed in the projecting portion of the open flange part to fix the clip to the projecting portion of the open flange part, the clip projecting portion being fitted into a recess portion provided in a nozzle guide projecting portion of the nozzle guide to restrict rotation of the nozzle guide relative to the open flange part; and a retaining portion that extends radially inward from the clip projecting portion and opposes a bottom flange portion of the nozzle guide projecting portion across a gap to support the nozzle guide in a radially- and axially-floating state.

4. The structure according to claim 3, wherein a bent portion of the clip abuts an outer peripheral face of a radially outer end of the projecting portion of the open flange part.

* * * * *